US010281847B2

(12) United States Patent
Yoshida et al.

(10) Patent No.: US 10,281,847 B2
(45) Date of Patent: May 7, 2019

(54) INTERMEDIATE TRANSFER MATERIAL, PRODUCTION METHOD OF THE SAME, AND ELECTROPHOTOGRAPHIC IMAGE-FORMING APPARATUS

(71) Applicant: Konica Minolta, Inc., Tokyo (JP)

(72) Inventors: Eiichi Yoshida, Hino (JP); Sadaaki Sakamoto, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 202 days.

(21) Appl. No.: 15/345,694

(22) Filed: Nov. 8, 2016

(65) Prior Publication Data

US 2017/0139354 A1 May 18, 2017

(30) Foreign Application Priority Data

Nov. 12, 2015 (JP) ..... 2015-221713

(51) Int. Cl.
*G03G 15/16* (2006.01)

(52) U.S. Cl.
CPC ..... *G03G 15/162* (2013.01)

(58) Field of Classification Search
CPC ..... G03G 15/162
See application file for complete search history.

(56) References Cited

U.S. PATENT DOCUMENTS 5,978,639 A * 11/1999 Masuda ..... G03G 15/162 399/302

FOREIGN PATENT DOCUMENTS

| | | | |
|---|---|---|---|
| JP | 2001106762 A | * | 4/2001 |
| JP | 2010156760 A | | 7/2010 |
| JP | 2014209176 A | | 11/2014 |

OTHER PUBLICATIONS

English language machine translation of JP 2001-106762 A (Year: 2001).*

* cited by examiner

*Primary Examiner* — Ramsey Zacharia
(74) *Attorney, Agent, or Firm* — Lucas & Mercanti, LLP

(57) ABSTRACT

Provided is an intermediate transfer material used for an electrophotographic image-forming apparatus in which a toner image held on an electrostatic latent image carrier is primarily transferred to an intermediate transfer material, and then, the primarily transferred toner image is transferred from the intermediate transfer material to a transfer material through a secondary transfer device, wherein the intermediate transfer material has a substrate layer and an elastic layer; and the elastic layer contains a structure composed of a rubber having a double bond ($C_2$) and a rubber having no double bond ($C_0$) being bonded with each other through a urethane bond.

3 Claims, 2 Drawing Sheets

INTERMEDIATE TRANSFER MATERIAL, PRODUCTION METHOD OF THE SAME, AND ELECTROPHOTOGRAPHIC IMAGE-FORMING APPARATUS

This application is based on Japanese Patent Application No. 2015-221713 filed on Nov. 12, 2015 with Japan Patent Office, the entire content of which is hereby incorporated by reference.

TECHNICAL FIELD

The present invention relates to an intermediate transfer material, a production method of the same, and an electrophotographic image-forming apparatus. More specifically, the present invention relates to an intermediate transfer material enabling to transfer an excellent secondary transfer image with less occurrence of stripes or unevenness to an uneven paper even after repeated usage, a production method of the same, and an electrophotographic image-forming apparatus using the same.

BACKGROUND

As an image-forming method of forming a toner image of excellent quality with a high speed, there is known a method of forming an image which contains the steps of: developing an electrostatic latent image on an electrostatic latent image carrier with a toner supplied from a developing roller, then transferring the formed toner image to a transfer material such as paper through an intermediate transfer material member.

With respect to the intermediate transfer material used in this method, there are required the following: excellent toner transferring property from the electrostatic latent image carrier to the intermediate transfer material, and also from the intermediate transfer material to the transfer material; and cleaning property of the remaining toner after transferring to the transfer material.

In recent years, the electrophotographic image-forming method uses a variety of transfer materials. It is required adaptability to a variety of paper including not only a plain paper and an OA exclusive paper, but also a thick paper, a coat paper, and further, a paper having unevenness on the surface (hereafter, it is called as an uneven paper). In particular, an uneven paper having an embossed treatment on the surface thereof has been frequently used for a business card and a cover of a printed matter because of its specific texture.

In order to form a good secondary transfer image on a thick paper or an uneven paper, it may be used an intermediate transfer belt that can absorb the thickness or unevenness of a transfer material (a recording material) as an intermediate transfer material used for an electrophotographic image-forming apparatus. For example, by using a rubber having elasticity for an intermediate transfer material, the surface of the intermediate transfer belt will follow the thick paper or the uneven paper, and improvement of the transfer property will be expected. Patent document 1 (JP-A No. 2010-156760) discloses an endless belt using a layered rubber elastic material containing an acrylonitrile-butadiene rubber for an electrophotographic image-forming apparatus.

However, when a rubber having a double bond is selected as an elastic material, the intermediate transfer material is rapidly deteriorated in the copying apparatus.

The intermediate transfer material having an elastic layer containing a rubber having a double bond, for example, a butadiene rubber (BR), a styrene-butadiene rubber (SBR), an acrylonitrile-butadiene rubber (NBR), an isoprene rubber (IR), and a butyl rubber (IIR), has an excellent transfer property to a paper having unevenness. However, when about 10,000 sheets of prints are made, the surface of the belt will be cracked and the formed crack will be transferred to the printed image.

The reason of this was investigated, and it was found that the formed ozone in the copying apparatus was the origin of this defect. It is thought that the double bond in the rubber structure was reacted with ozone. Because the double bond was broken or cross-linked, the rubber became stiff and it was broken.

On the other hand, although a rubber having no double bond exhibits good ozone resistance, it has problems of inferior mechanical strength and high electric resistance for using as an elastic material of an intermediate transfer material.

The rubber having no double bond, such as an ethylene-propylene rubber (EPM), and an acrylic rubber (ACM), has a high electric resistance. When an electron conducting agent such as carbon black is added for the purpose of adjusting the resistance, the rubber becomes stiff. As a result, it may not be obtained an advantage of achieving high transfer property towards an uneven paper. When an electric resistance is adjusted with an ion conducting agent, the ion conducting agent will bleed out in the copying apparatus during the operation, and it will cause a problem of degradation of the image quality by contamination to the member such as a photoreceptor. In the case of an acrylic rubber (ACM) having a relatively low electric resistance, it has a low repulsion elasticity, and has a small return after passing through press sections of a cleaning member and a transfer section. As a result, the surface will undulate, and this becomes the cause of density unevenness.

As a measure to these problems, Patent document 2 (JP-A No. 2014-209176) discloses an intermediate transfer material using a heat cured substance formed with a matrix polymer containing an acrylonitrile-butadiene rubber and a multivalent polyisocyanate. However, the transfer property to an uneven paper was not sufficient.

Consequently, it is required an intermediate transfer material enabling to transfer an excellent secondary transfer image with less occurrence of stripes or unevenness to an uneven paper even after repeated usage.

SUMMARY

The present invention was done based on the above-described problems and situations. An object of the present invention is to provide an intermediate transfer material enabling to transfer an excellent secondary transfer image with less occurrence of stripes or unevenness to an uneven paper even after repeated usage. And further, an object of the present invention is to provide a production method of the same, and an electrophotographic image-forming apparatus using the same.

The present inventors have made investigation to solve the above-described problems. The present invention has been achieved by finding out that the above-described problems are resolved by using an intermediate transfer material having an elastic layer containing a structure composed of a rubber having a double bond and a rubber having no double bond that are bonded with each other through a urethane bond.

Namely, the problems relating to the present invention are solved by the following embodiments.

1. An intermediate transfer material used for an electrophotographic image-forming apparatus in which a toner image held on an electrostatic latent image carrier is primarily transferred to an intermediate transfer material, and then, the primarily transferred toner image is transferred from the intermediate transfer material to a transfer material through a secondary transfer device,
   wherein the intermediate transfer material has a substrate layer and an elastic layer; and
   the elastic layer contains a structure composed of a rubber having a double bond ($C_2$) and a rubber having no double bond ($C_0$) being bonded with each other through a urethane bond.
2. The intermediate transfer material described in the embodiment 1, wherein a mass ratio of the rubber having a double bond ($C_2$) to the rubber having no double bond ($C_0$) satisfies Scheme 1.

$$0.5 \leq C_2/(C_2+C_0) \leq 0.9 \quad \text{Scheme 1:}$$

3. The intermediate transfer material described in the embodiments 1 or 2, wherein the rubber having a double bond ($C_2$) and the rubber having no double bond ($C_0$) each are a hydroxy group modified rubber.
4. A method of producing an intermediate transfer material used for an image-forming apparatus in which a toner image held on an electrostatic latent image carrier is primarily transferred to an intermediate transfer material, and then, the primarily transferred toner image is transferred from the intermediate transfer material to a transfer material through a secondary transfer device,
   wherein the intermediate transfer material has a substrate layer and an elastic layer,
   the method comprising the step of:
   producing the elastic layer by using a multivalent polyisocyanate, a rubber having a double bond ($C_2$) with an active hydrogen atom, and a rubber having no double bond ($C_0$) with an active hydrogen atom by curing with heat or UV rays.
5. An electrophotographic image-forming apparatus in which a toner image held on an electrostatic latent image carrier is primarily transferred to an intermediate transfer material, and then, the primarily transferred toner image is transferred from the intermediate transfer material to a transfer material through a secondary transfer device,
   wherein the electrophotographic image-forming apparatus comprises the intermediate transfer material described in any one of the embodiments 1 to 3.

By the above-described embodiments, it is possible to provide an intermediate transfer material enabling to transfer an excellent secondary transfer image with less occurrence of stripes or unevenness to an uneven paper even after repeated usage. And further, it is possible to provide a production method of the same, and an electrophotographic image-forming apparatus using the same.

A formation mechanism or an action mechanism of the effects of the present invention is not made clear, but it is supposed to be as follows.

By the presence of a structure composed of a rubber having a double bond and a rubber having no double bond that are bonded with each other through a urethane bond, it is possible to ensure an electric resistance property and an mechanical property by a rubber having a double bond, and it is possible to ensure an ozone resistive property by a rubber having no double bond. Moreover, by binding them with a urethane bond, it is possible to improve rubber elasticity in the polymer portion, and it is possible to adjust electric resistance by the urethane portion.

DESCRIPTION OF THE PREFERRED EMBODIMENTS

Figure 1:
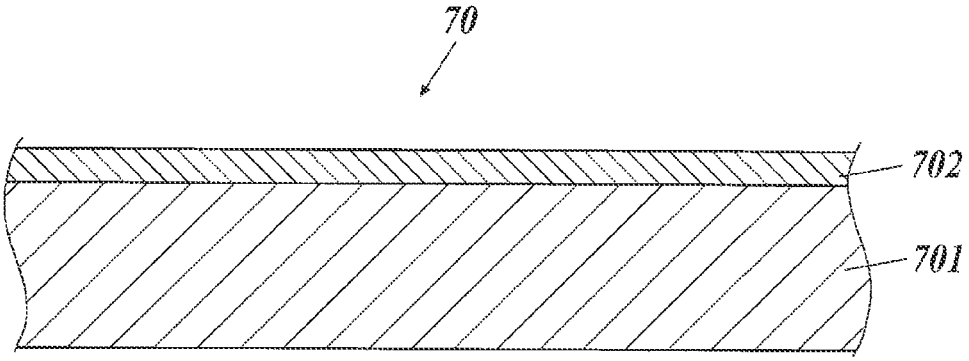
FIG. 1 is a schematic cross-sectional drawing illustrating an example of a layer structure of an intermediate transfer material.

An intermediate transfer material of the present invention is a member used for an electrophotographic image-forming apparatus in which a toner image held on an electrostatic latent image carrier is primarily transferred to an intermediate transfer material, and then, the primarily transferred toner image is transferred from the intermediate transfer material to a transfer material through a secondary transfer device.

It is characterized in that the intermediate transfer material has a substrate layer and an elastic layer, and that the elastic layer contains a structure composed of a rubber having a double bond ($C_2$) and a rubber having no double bond ($C_0$) being bonded with each other through a urethane bond.

This technical feature is common to the inventions relating to the above-described embodiments 1 to 5.

One of the preferable embodiments of the present invention is that a mass ratio of the rubber having a double bond ($C_2$) to the rubber having no double bond ($C_0$) satisfies Scheme 1 from the viewpoint of satisfying both strength and ozone resistance of the elastic layer. Further, it is preferable that the rubber having a double bond ($C_2$) and the rubber having no double bond ($C_0$) each are a hydroxy group modified rubber.

Another preferable embodiment of the present invention is a method of producing an intermediate transfer material used for an electrophotographic image-forming apparatus in which a toner image held on an electrostatic latent image carrier is primarily transferred to an intermediate transfer material, and then, the primarily transferred toner image is transferred from the intermediate transfer material to a transfer material through a secondary transfer device, wherein the intermediate transfer material has a substrate layer and an elastic layer. This method contains the step of: producing the elastic layer by using a multivalent polyisocyanate, a rubber having a double bond ($C_2$) with an active hydrogen atom, and a rubber having no double bond ($C_0$) with an active hydrogen atom by curing with heat or UV rays.

An intermediate transfer material of the present invention is suitably used for an electrophotographic image-forming apparatus.

The present invention and the constitution elements thereof, as well as the embodiments to carry out the present invention, will be detailed in the following. In the present description, when two figures are used to indicate a range of value before and after "to", these figures themselves are included in the range as a lowest limit value and an upper limit value.

«General Outline of Intermediate Transfer Material»

An intermediate transfer material of the present invention is a member used for an electrophotographic image-forming apparatus in which a toner image held on an electrostatic latent image carrier is primarily transferred to an intermediate transfer material, and then, the primarily transferred toner image is transferred from the intermediate transfer material to a transfer material through a secondary transfer device.

It is characterized in that the intermediate transfer material has a substrate layer and an elastic layer, and that the elastic layer contains a structure composed of a rubber having a double bond ($C_2$) and a rubber having no double bond ($C_0$) being bonded with each other through a urethane bond.

An intermediate transfer material of the present invention preferably has a layer structure composed of a substrate layer having thereon an elastic layer.

FIG. 1 is a schematic cross-sectional drawing illustrating an example of a layer structure of an intermediate transfer material.

In FIG. 1, a numeral 70 indicates an intermediate transfer material, a numeral 701 indicates a substrate layer, and a numeral 702 indicates an elastic layer.

Figure 2:
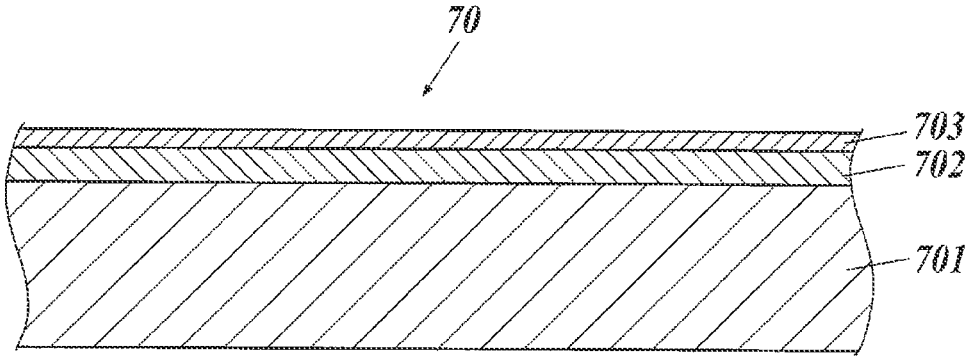
FIG. 2 is a schematic cross-sectional drawing illustrating another example a layer structure of an intermediate transfer material.

A surface layer 703 may be further placed on the elastic layer 702 as illustrated in FIG. 2. The surface layer 703 is an optionally formed layer.

A thickness of an intermediate transfer material may be suitably determined according to the purpose of use. Generally, a preferable thickness is in the range of 150 to 500 μm that will satisfy the mechanical properties of strength and flexibility. More preferably, it is in the range of 200 to 400 μm.

A shape of an intermediate transfer material is preferably an intermediate transfer belt having an endless structure. It has the following advantages: having no variation of thickness due to overlapping; any portion of the belt can be made to be a starting position of the belt rotation; and a control mechanism for rotation starting position can be omitted.

As an uneven paper, it is suitably used a paper having a large uneven surface structure treated with an embossed processing, and a basis weight in the range of 150 to 300 gsm.

«Elastic Layer»

An elastic layer that constitutes an intermediate transfer material of the present invention is characterized in that it has a structure composed of a rubber having a double bond ($C_2$) and a rubber having no double bond ($C_0$) being bonded with each other through a urethane bond.

By incorporating this structure in the elastic layer, it is possible to ensure an electric resistance property and an mechanical property by a rubber having a double bond, and it is possible to ensure an ozone resistive property by a rubber having no double bond. Moreover, by binding them with a urethane bond, it is possible to improve rubber elasticity in the polymer portion, and it is possible to adjust electric resistance by the urethane portion.

The elastic material having this structure may be obtained by reacting a rubber having a double bond and a rubber having no double bond with a multivalent polyisocyanate to result in binding the rubber having a double bond and the rubber having no double bond through a urethane bond.

Specifically, it may be obtained as follows. The rubbers each having a functional group containing an active hydrogen atom (a hydroxy group, a carboxy group, or an amino group) and a multivalent polyisocyanate are mixed. Then the mixture is heated or irradiated with UV rays to obtain the above-described structure. The multivalent polyisocyanate has a function of cross-linking agent to cross-link the rubber having a double bond and the rubber having no double bond.

[Rubber Having a Double Bond]

A rubber having a double bond is a rubber containing a double bond in the main chain. Examples thereof are: a butadiene rubber (BR), a styrene-butadiene rubber (SBR), an acrylonitrile-butadiene rubber (NBR), an isoprene rubber (IR), and a butyl rubber (IIR). A known method may be used for introducing a functional group containing an active hydrogen atom into these rubbers. For example, it may be produced by polymerizing a monomer containing an active hydrogen atom, or it may be produced by using a monomer containing an active hydrogen atom as a co-polymerizing component to form these rubbers.

The rubber having an active hydrogen atom modified with a hydroxy group or a carboxy group may be obtained in the market. For examples, it may be cited: G-1000, G-2000, G-3000, and GQ-1000 (hydroxy group modified BR, made by Nippon Soda Co. Ltd); and Nipol 1072J, and NX775 (carboxy group modified NBR, made by Zeon Co. Ltd.)

[Rubber Having No Double Bond]

A rubber having no double bond is a rubber containing no double bond in the main chain as a result of polymerization and hydrogenation reaction (reduction) to saturate the double bond. Although the usable rubber is not limited in particular as long as the rubber contains no double bond in the main chain, a suitably used rubber is an olefin type co-polymer rubber that is a non-diene type rubber. Examples of the olefin type co-polymer rubber are: ethylene-propylene rubber (EPM); ethylene-propylene-non-conjugated diene rubber prepared by introducing a non-conjugated diene component such as ethylidene norbornene or dicyclopentadiene-1,4-hexadiene; ethylene-butene copolymer; butyl rubber; chlorosulfonated polyethylene; and chlorinated polyethylene.

Other than the above-described olefin type co-polymers, it may be cited: acrylic rubber having an alkyl acrylate or alkyl methacrylate, urethane rubber, silicone rubber, epichlorohydrin rubber, and fluorine rubber. These may be used alone, or they may be used in combination of two or more kinds.

A known method may be used for introducing a functional group containing an active hydrogen atom into these rubbers. For example, it may be produced by polymerizing a monomer containing an active hydrogen atom, or it may be produced by using a monomer containing an active hydrogen atom as a co-polymerizing component to form these rubbers. Otherwise, it may be produced by reducing an ester portion of the acrylic rubber.

It is preferable that a mass ratio of the rubber having a double bond ($C_2$) to the rubber having no double bond ($C_0$) satisfies Scheme 1. It is preferable to make the mass ratio in this range from the viewpoint of satisfying both strength and ozone resistance of the elastic layer.

$$0.5 \leq C_2/(C_2+C_0) \leq 0.9 \qquad \text{Scheme 1:}$$

[Multivalent Polyisocyanate]

As a polyisocyanate, it may be used a compound having two or more isocyanate groups in the molecule without specific limitation.

Examples of a polyisocyanate are: aromatic polyisocyanates such as TDI (e.g., 2,4-tolylene diisocyanate (2,4-TDI), 2,6-tolylene diisocyanate (2,6-TDI)), MDI (e.g., 4,4'-diphenylmethane diisocyanate (4,4'-MDI), 2,4'-diphenylmethane diisocyanate (2,4'-MDI)), 1,4-phenylene diisocyanate, polymethylene polyphenylene polyisocyanate, xylylene diisocyanate (XDI), tetramethyl diisocyanate (TMXDI), toluidine diisocyanate (TODI), 1,5-naphthalene diisocyanate (NDI), and triphenylmethane triisocyanate; aliphatic polyisocyanates such as hexamethylene diisocyanate (HMDI), trimethyl hexamethylene diisocyanate (TMHDI), and lysine diisocyanate; alicyclic polyisocyanates such as trans-cyclohexane-1,4-diisocyanate, isophorone diisocyanate (IPDI), bis (isocyanatomethyl) cyclohexane ($H_6$XDI), dicyclohexylmethane diisocyanate ($H_{12}$MDI), and norbornane diisocyanate (NBDI); carbodiimide-modified polyisocyanates of these compounds; and isocyanurate-modified polyisocyanates of these compounds.

These polyisocyanates may be used alone, or they may be used in combination of two or more kinds.

A polyisocyanate is preferably used in the range of 2 to 8 mass % with respect to the total mass of the rubber.

[Method of Forming an Elastic Layer]

A preferable production method of an elastic layer is as follows. A coating composition containing a rubber having a double bond, a rubber having no double bond each having an active hydrogen atom, polyisocyanate, and other component such as a solvent when required, is coated on a substrate to form a coating film. Then, this coating film is subjected to a heating treatment to obtain an elastic layer. A polymerization initiator may be added to the coating composition, and it may be formed an elastic layer by giving heat or UV rays to the coating film.

[Polymerization Initiator]

The polymerization initiator may be a photopolymerization initiator. Examples of such a photopolymerization initiator include: acetophenone compounds, benzoin ether compounds, benzophenone compounds, sulfur compounds, azo compounds, peroxide compounds, and phosphine oxide compounds.

Specific examples of the polymerization initiator include: carbonyl compounds such as benzoin, benzoin methyl ether, benzoin ethyl ether, benzoin isopropyl ether, acetoin, butyroin, toluoin, benzil, benzophenone, p-methoxybenzophenone, diethoxyacetophenone, α,α-dimethoxy-α-phenylacetophenone, methyl phenylglyoxylate, ethyl phenylglyoxylate, 4,4'-bis(dimethylaminobenzophenone), 2-hydroxy-2-methyl-1-phenylpropane-1-one, 2,2-dimethoxy-1,2-diphenylethan-1-one, and 1-hydroxycyclohexyl phenyl ketone; sulfur compounds such as tetramethylthiuram monosulfide and tetramethylthiuram disulfide; azo compounds such as azobisisobutyronitrile and azobis-2,4-dimethylvaleronitrile; and peroxide compounds such as benzoyl peroxide and di-t-butyl peroxide. These may be used alone, or they may be used in combination of two or more kinds.

Preferred are 1-hydroxycyclohexyl phenyl ketone, 2-hydroxy-2-methyl-1-phenylpropane-1-one, and 1-[4-(2-hydroxyethoxy)-phenyl]-2-hydroxy-2-methyl-1-propane-1-one in view of photostability, highly efficient photocleavage, surface curability, compatibility with a specific curable resin, low volatility, and low odor.

A content of a photopolymerization initiator contained in the coating composition is preferably 1 to 10 mass %. More preferably, it is 2 to 8 mass %, and still more preferably, it is 3 to 6 mass %, in view of high curability, sufficient hardness of the resultant surface layer, and high adhesion of the surface layer to the belt substrate.

The coating composition preferably contains a solvent in view of improvement in applicability (workability).

Specific examples of the solvent include: ethanol, isopropanol, butanol, toluene, xylene, acetone, methyl ethyl ketone, ethyl acetate, and butyl acetate.

The coating composition may contain the following additives within the limit of not deteriorating the effects of the present invention. Examples of the additive are: a conductive material, a filler, an aging resistant agent, an antistatic agent, a flame retardant, an adhesive a tackifier, a dispersant, an antioxidant, a defoaming agent, a leveling agent, a matting agent, a light stabilizer (e.g., a hindered amine compound), a dye, and a pigment.

A method for coating the coating composition on the substrate material is not specifically limited. Examples thereof are known methods such as: a brush coating method, a flow coating method, a dip coating method, a spray coating method, and a spin coating method.

An amount of coating of the coating composition may be an adjusted amount by which the required thickness is achieved for the obtained specific surface layer.

As a method of curing the coating composition, it may be cited a method of heating, or a method of irradiating with UV rays, for example.

When the coating composition is cured with heat, it may be heated under the condition of a temperature of 80 to 120° C.

When the coating composition is cured by irradiating with UV rays, a preferable amount of UV ray irradiation is in the range of 500 to 3,000 mJ/cm$^2$ from the viewpoint of quick curing and workability.

When the coating composition is cured by irradiating with UV rays, the temperature is preferably set to be 80 to 120° C.

An apparatus to irradiate with UV rays is not limited in particular, it may be used a known method in the art.

The coating film formed by coating with the coating composition is dried to remove the solvent. The drying of the coating film may be done at any time of before, after and during polymerization of the polymerizable component. It may be done by suitably combining the timing. Specifically, the primary drying is done to an extent that the coating film loses its fluidity, then, the polymerization is done. Afterward, it is preferable to do the secondary drying in order that the amount of the volatile substance in the protective layer becomes to a predetermined value.

The drying method of the coating film may be suitably selected by considering the kind of the solvent and the thickness of the protective layer to be formed. The drying temperature is preferably in the range of 40 to 100° C., and more preferably, about 60° C. The drying time is preferably in the range of 1 to 5 minutes, for example.

The thickness of the elastic layer is not limited in particular as long as it may achieve the effect of the present invention. By considering the thickness of the paper and the function of the intermediate transfer material capable of flexibly following the uneven paper, the thickness of the elastic layer is preferably in the range of 150 to 400 μm, and more preferably in the range of 150 to 300 μm.

«Substrate Layer»

A substrate layer according to the present invention is not limited in particular. It may be produced with a known material by using a known forming method.

Examples of a known material are: resin materials such as polycarbonate, polyphenylene sulfide, polyvinylidene fluoride, polyimide, polyether, and polyether ketones; and resins having polyphenylene sulfide as a main component.

As a known forming method, it may be cited a method of coating a coating liquid of a resin dissolved in a solvent, or a method of directly forming a film made of a resin. Preferable is a method of directly forming a film made of a resin.

As a method of directly forming a film made of a resin, it may be cited an extrusion molding method and an inflation molding method. In both methods, a resin material and various conductive substances are mixed and melted. In the case of an extrusion molding method, the resin is extruded and then cooled to be molded. In the case of an inflation molding method, the melted resin is made in a tube shape in a mold, then, air is introduced with a blower. Afterward, the resin is cooled to form an endless belt form.

In the following, it will be described a substrate layer using a resin having polyphenylene sulfide as a main component, and a specific method of producing a substrate layer by using an extrusion molding method.

The substrate layer made of a resin having polyphenylene sulfide as a main component is formed with: polyphenylene sulfide, a graft co-polymer composed of an epoxy group containing olefin co-polymer and a vinyl (co-)polymer, a conductive filler, and a lubricant.

Polyphenylene sulfide (PPS) used in the present invention is a thermoplastic plastic having a structure composed of a phenylene unit and a sulfur atom alternately arrayed.

The phenylene unit is an o-phenylene unit, a m-phenylene unit, or a p-phenylene unit, which may have a substituent. These units may be mixed. A preferable phenylene unit contains at least a p-phenylene unit. The content thereof is 50% or more with respect to the total phenylene units. The phenylene unit is preferably composed of a p-phenylene unit having no substituent.

As a conductive filler used in the present invention, it may be cited carbon black. Neutral carbon black may be used as carbon black. A used amount of the conductive filler depends on the kind of the used conductive filler. It may be added in an amount that enables to obtain a volume-resistance and a surface resistance of a predetermined range of value. Generally, the added amount of the conductive filler is in the range of 10 to 20 mass parts, preferably in the range of 10 to 16 mass parts with respect to 100 mass parts of polyphenylene sulfide.

A lubricant used in the present invention improves moldability to the intermediate transfer material. Examples thereof are: aliphatic hydrocarbons such as paraffin wax and polyolefin wax; higher aliphatic acids such as lauric acid, myristic acid, palmitic acid, stearic acid, and behenic acid; and metal salts of higher aliphatic acids such as sodium salt, lithium salt, and calcium salt. These lubricants may be used alone, or they may be used in combination of two or more kinds. A used amount of the lubricant is in the range of 0.1 to 0.5 mass parts, more preferably it is in the range of 0.1 to 0.3 mass parts with respect to 100 mass parts of polyphenylene sulfide.

The substrate layer according to the present invention may be formed as follows. A circular die is attached to a single screw extruder. The mixture made of the above-described materials is loaded in the extruder. The melted resin composition is extruded from the resin exit having a seamless belt form at the head of the circular die. Afterward, the resin is cooled by placing in a cooling cylinder having a cooling mechanism to solidify. Thus, the resin may be easily formed in a seamless tube shape.

As a measure of preventing crystallization during the process, it is preferable to cool the belt immediately after extruded from the die with a metal block cooled with water or air. Specifically, it is used a cooling cylinder that is placed to the die by putting an insulating material. The heat of the belt is rapidly taken away by this. Temperature-controlled water at 30° C. or less is constantly circulated inside of the cooling cylinder. By rapidly taking away the belt extruded from the die, it may be increased the cooling rate of the thin film. Here, the taking away rate is preferably 1 m/min or more, more preferably in the range of 2 to 7 m/min.

When a ratio of a diameter of a circular die (ΦD) to a diameter of a cooling cylinder (Φd), D/d, is in the range of 0.9 to 1.1, the resin extruded from the circular die to the cooling cylinder is taken out by a receiving device. When D/d, is in the range of 0.9 to 0.98, it is required to evacuate the space between the circular die and the cooling cylinder for the purpose of fitting the resin on the cooling cylinder. However, when D/d, is in the range of 0.99 to 1.02, the resin may be fit on the cooling cylinder without evacuating the space between the circular die and the cooling cylinder. The pulsing motion of the evacuation is avoided, and it will produce an advantage that a film thickness variation in the taking out direction will hardly occur.

«Surface Layer»

In the intermediated transfer material of the present invention, the surface layer is an optionally formed layer. By having this surface layer, durability of the intermediated transfer material may be improved. The surface layer that constitutes the intermediated transfer material preferably contains a cured (meth) acrylic resin and metal oxide particles treated with a surface treatment.

The cured (meth)acrylic resin is preferably obtained by curing a curable composition made of at least three component of: multi-functional (meth)acrylate, polyurethane-acrylate, and polymerizable component having a low surface energy group. The specific constitution of these substances is not limited in particular, a known knowledge in the art may be suitably referred to.

The metal oxide particles treated with a surface treatment contained in the surface layer may be obtained by using metal oxide particles without treatment (hereafter, they may be called as "untreated metal oxide particles"), and a surface treatment is carried out with a surface treating agent.

The untreated metal oxide particles used in the present invention may be made of metal oxides including transition metal oxides. Examples thereof are: silicon oxide (silica), magnesium oxide, zinc oxide, lead oxide, aluminum oxide, tantalum oxide, indium oxide, bismuth oxide, yttrium oxide, cobalt oxide, copper oxide, manganese oxide, selenium oxide, iron oxide, zirconium oxide, germanium oxide, tin oxide, titanium oxide, niobium oxide, molybdenum oxide, and vanadium oxide. Among them, titanium oxide, aluminum oxide, zinc oxide, and tin oxide are preferable. In particular, aluminum oxide and tin oxide are preferable.

As a surface treating agent used for the untreated metal oxide particles, it may be cited a compound having a radical polymerizable functional group. Examples of a radical polymerizable functional group are: an acryloyl group and a methacryloyl group.

The surface layer may incorporate the following additive compositions according to necessity: an organic solvent, a light stabilizer, an UV absorber, a catalyst, a coloring agent, an antistatic agent, a lubricant, a leveling agent, an anti-foaming agent, a polymerization accelerator, an antioxidant, a flame retardant, an infrared absorbing agent, a surfactant, and a surface modification agent. A thickness of the surface layer is preferably 1 to 5 μm by consideration of mechanical strength, image quality, and production cost.

«Image-Forming Method and Image-forming Apparatus»

An image-forming method and an image-forming apparatus according to the present invention will be described in the following.

The image-forming apparatus preferably contains the following on the electrostatic latent image carrier (it may be called as a photoreceptor): a charging unit, an exposure unit, a developing unit using a developer containing a small sized toner, a transfer unit to transfer the developed toner image through an intermediated transfer material.

Specifically, it may be cited a copying machine and a laser printer. In particular, it is preferable to use an image-forming apparatus capable of continuously printing 5,000 sheets of prints or more. In this kind of apparatus, an electric field may be easily generated between the intermediated transfer material and the transfer material due to the production of a large amount of prints in a short time. The intermediated transfer material of the present invention will restrain the generation of the electric field and a stable secondary transfer may be conducted.

The image-forming apparatus that may be used the intermediated transfer material of the present invention has the following members: a photoreceptor that forms an electrostatic latent image corresponding to the image information, a developing device for developing the electrostatic latent image formed on the photoreceptor, a primary transfer unit for transferring a toner image on the photoreceptor to an intermediate transfer material, and a secondary transfer device for transferring the toner image on the intermediate transfer material to a transfer material such as paper or an OHP sheet. By having the intermediate transfer material of the present invention as an intermediate transfer material, a stable toner image formation will be done without generating peeling discharge during the secondary transferring process.

As an image-forming apparatus that may use the intermediated transfer material of the present invention, it may be cited: a mono-chromatic image-forming apparatus that forms an image with a mono-chromatic toner, a color image-forming apparatus that sequentially transfer a toner image of a photoreceptor to an intermediated transfer material, and a tandem color image-forming apparatus that has a plurality of photoreceptors for different colors each arranged in series on an intermediated transfer material.

The intermediate transfer material of the present invention is effectively used for a tandem color image formation.

Figure 3:
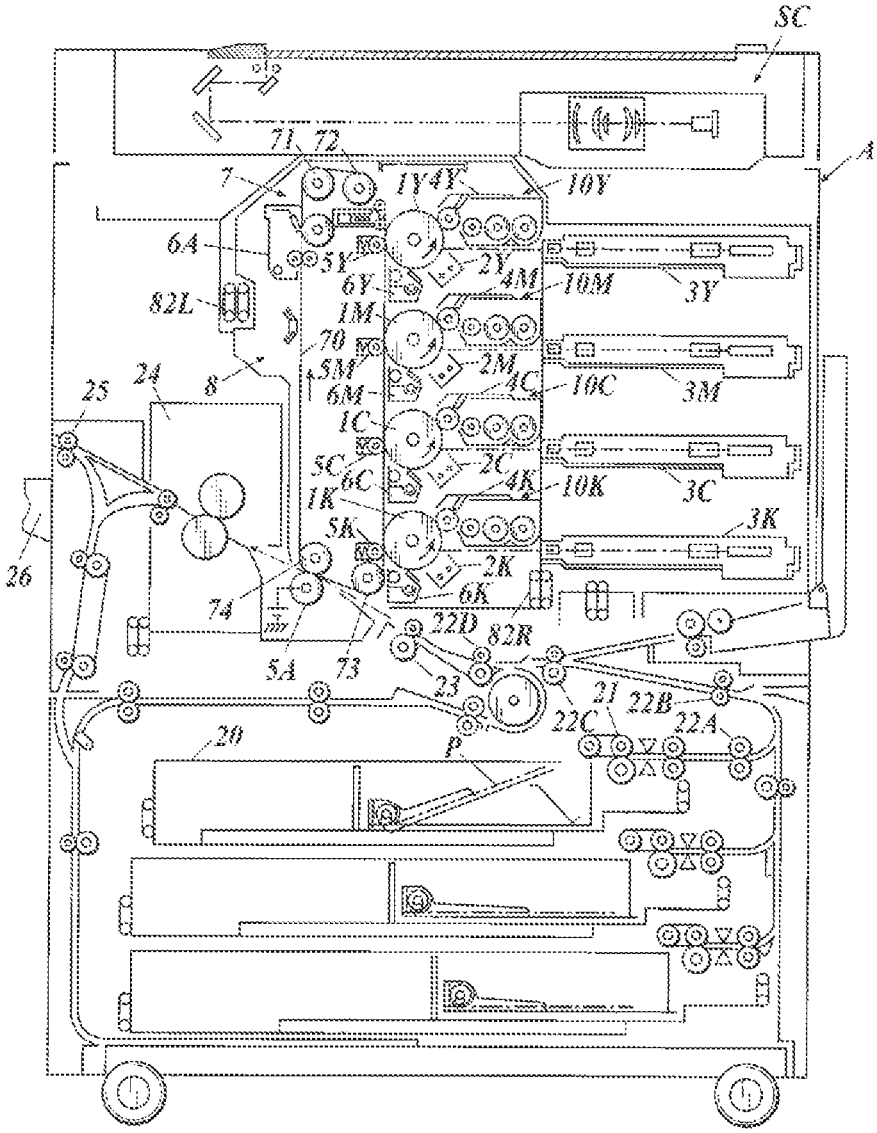
FIG. 3 is a cross-sectional constitution diagram illustrating an example of an image-forming apparatus in which an intermediate transfer material of the present invention is usable.

FIG. 3 is a cross-sectional constitution diagram illustrating an example of an image-forming apparatus in which the intermediate transfer material of the present invention is usable.

In FIGS. 3, 1Y, 1M, 1C and 1K each designate a photoreceptor; 4Y, 4M, 4C and 4K each designate a developing unit; 5Y, 5M, 5C and 5K each designate a primary transfer roller as a primary transfer unit; 5A designates a secondary transfer roller as a secondary transfer device; 6Y, 6M, 6C and 6K each designate a cleaning unit; the numeral 7 designates an intermediate transfer material unit; the numeral 24 designates a heat roller fixing device; and the numeral 70 designates an intermediate transfer material.

This image-forming apparatus is called a tandem color image-forming apparatus, which is composed of: a plurality of image-forming sections 10Y, 10M, 10C and 10K; an intermediate transfer material unit 7 of an endless belt form as a transfer section; a paper feeding and conveying unit 21 of an endless belt form to convey a recording member P; and a heat roller fixing device 24. An original image reading device SC is disposed in the upper section of the image-forming apparatus body A.

For one of the color toner images on the each photoreceptors, the image-forming section 10Y that forms a yellow image contains: a drum-form photoreceptor 1Y as a first image carrier; an electrostatic-charging unit 2Y which is disposed around the photoreceptor 1Y; an exposure unit 3Y; and a developing unit 4Y; a primary transfer roller 5Y as a primary transfer unit; and a cleaning unit 6Y.

For another color toner image, the image-forming section 10M that forms a magenta image contains: a drum-form photoreceptor 1M as a first image carrier; an electrostatic-charging unit 2M which is disposed around the photoreceptor 1M; an exposure unit 3M; and a developing unit 4M; a primary transfer roller 5M as a primary transfer unit; and a cleaning unit 6M.

For another color toner image, the image-forming section 10C that forms a cyan image contains: a drum-form photoreceptor 1C as a first image carrier; an electrostatic-charging unit 2C which is disposed around the photoreceptor 1C; an exposure unit 3C; and a developing unit 4C; a primary transfer roller 5C as a primary transfer unit; and a cleaning unit 6C.

And further, for another color toner image, the image-forming section 10K that forms a black image contains: a drum-form photoreceptor 1K as a first image carrier; an electrostatic-charging unit 2K which is disposed around the photoreceptor 1K; an exposure unit 3K; and a developing unit 4K; a primary transfer roller 5K as a primary transfer unit; and a cleaning unit 6K.

The intermediate transferring material unit 7 of an endless belt form includes: the intermediate transfer material 70 of an endless belt form that are rotatably wound by a plurality of rollers. The intermediate transfer material 70 is a secondary image carrier.

The individual color images formed in the image-forming sections 10Y, 10M, 10C and 10K are successively transferred onto the moving intermediate transfer material 70 of an endless belt form by the primary transfer rollers 5Y, 5M, 5C and 5K, respectively, to form a composite color image. The recording member P made of paper, as a final transfer material housed in a paper feed cassette 20, is fed by a paper feed and conveyance unit 21 and conveyed to a secondary transfer roller 5A through a plurality of intermediate rollers 22A, 22B, 22C and 22D and a resist roller 23, and color images are transferred together on the recording member P. The color image transferred on the recording member (P) is fixed by a heat roller fixing device 24. Then the paper is nipped by a paper discharge roller 25, and put onto a paper discharge tray 26 placed outside of the apparatus.

On the other hand, after transferring the color image onto the transfer material P with the second transferring roller 5A, and after conducting the curved separation of the transfer material P from the endless belt form intermediate transfer material 70, the residual toner on the intermediate transfer belt 70 is removed by the cleaning unit 6A.

During an image-forming process, the primary transfer roller 5K is always compressed to the photoreceptor 1K. Other primary rollers 5Y, 5M and 5C are compressed to the photoreceptors 1Y, 1M and 1C, respectively, only when the color images are formed.

The secondary transfer roller 5A is compressed onto the intermediate transfer material 70 of an endless belt form only when the recording member P passes through to perform secondary transfer.

A housing 8 has a structure which can be drawn from the apparatus body A via rails 82L and 82R.

The housing 8 accommodates the image-forming sections 10Y, 10M, 10C, and 10K, and the endless belt form intermediate transfer material unit 7.

The image-forming sections 10Y, 10M, 10C, and 10K are aligned in the vertical direction. The endless belt form intermediate transfer material unit 7 is disposed on the left of the photoreceptors 1Y, 1M, 1C, and 1K in the figure.

The endless belt form intermediate transfer material unit 7 includes: the intermediate transfer material 70 of an endless belt form that are rotatably wound around a plurality of rollers 71, 72, 73, and 74; the first transfer rollers 5Y, 5M, 5C, and 5K; and the cleaning unit 6A.

By the operation of drawing the housing 8, the image-forming sections 10Y, 10M, 10C, and 10K, and the endless belt form intermediate transfer material unit 7 are taken out as a whole from the apparatus body.

As described above, in the process of image formation, toner images are formed on the photoreceptors 1Y, 1M, 1C and 1K, through electrostatic-charging, exposure and development. The toner images of the individual colors are superimposed on the endless belt form intermediate transfer material 70, the images are transferred together onto the recording member P, and fixed by compression and heating in the heat roller fixing device 24. After completion of transferring the toner image to the recording member P, any toner remained on the intermediate transfer material 70 is cleaned by the cleaning device 6A and then goes into the foregoing cycle of electrostatic-charging, exposure and development to perform the subsequent image formation.

<Transfer Material>

The transfer material used in the present invention is a support to hold an toner image. It may be used a various materials such as: a plain paper from thin paper to thick paper, a printing paper of an art paper and a coat paper, a commercially available Japanese paper and a post card paper, a plastic film for OHP, and a cloth. In the present invention, it is suitably used a paper having a large uneven surface structure treated with an embossed processing, and a basis weight in the range of 150 to 300 gsm.

EXAMPLES

Hereinafter, specific examples of the present invention will be described, but the present invention is not limited thereto. In the present examples, the description of "parts" or "%" is used, it represents "mass parts" or "mass %" unless specific notice is given.

Example 1

«Production of Intermediate Transfer Material 1»

[Substrate]

A belt used in an image-forming apparatus "Bizhub™ PRESS C1100" (made by Konica Minolta, Inc.) was prepared for a substrate. This substrate was called as an endless-belt form substrate (1).

[Preparation of Elastic Layer]

20 mass parts of hydroxy group modified butadiene rubber (BR1) as a rubber having a double bond and 80 mass parts of hydroxy group modified acrylic rubber (ACM1) as a rubber having no double bond were mixed. Then the mixture was dissolved in methyl ethyl ketone to have a concentration of 20 mass %. To this was added 4 mass parts of hexamethylene diisocyanate (HMDI) as a cross-linking agent of a multivalent isocyanate (Duranate™ 101, made by Asahi Kasei Co. Ltd.). The mixture was stirred and dissolved to obtain a coating liquid for forming an elastic layer (1).

Hydroxy group modified acrylic rubber (ACM1) having no double bond was prepared by reducing an ester portion of an acrylic rubber (APREX™ 110, made by JSR CO. Ltd.).

[Formation of Elastic Layer]

The coating liquid for forming an elastic layer (1) was coated on an outer periphery of the endless-belt form substrate (1) with a dip-coating method. Then, the coated layer was dried to obtain a film (1) having a dry thickness of 200 μm.

[Surface Treatment]

This film (1) was irradiated with UV rays under the following conditions to cure the film surface and to form an elastic layer 1. Thus, an intermediate transfer material 1 was obtained.

Irradiation Conditions of UV Rays

Type of light source: High pressure mercury lamp "H04-L41" (made by Eye Graphics Co. Ltd.)

Distance between the irradiation port and the coated film surface: 100 mm

Irradiation amount: 1 J/cm$^2$

Moving speed (rotation speed) of the coated film to the fixed light source: 60 mm/sec Irradiation time (time for rotating the coated film): 240 seconds «Production of Intermediate Transfer Materials 2 to 7»

Intermediate transfer materials 2 to 7 each were prepared in the same manner as preparation of the intermediate transfer material 1 except that the kinds of the rubber having a double bond ($C_2$) and the rubber having no double bond ($C_0$) both constituting the elastic layer, and their mass ratio were changed as described in Table 1.

In the preparation of the intermediate transfer material 7, 2 mass parts of sulfur were used as a cross-linking agent in place of HMD1.

Abbreviations in Table 1 indicate the following.

BR1: Hydroxy group modified butadiene rubber (CQ-1000, made by Nippon Soda Co. Ltd.)

NBR1: Carboxy group modified acrylonitrile-butadiene rubber (Nipol 1072, made by Zeon Co. Ltd.)

BR2: Butadiene rubber

ACM1: Hydroxy group modified acrylic rubber

TABLE 1

| Intermediate Transfer Material No. | Rubber having a double bond ($C_2$) | Rubber having no double bond ($C_0$) | Mass ratio $C_2/(C_2 + C_0)$ | Cross-linking agent | Re-marks |
|---|---|---|---|---|---|
| 1 | BR1 | ACM1 | 0.90 | HMDI | Inv. |
| 2 | BR1 | ACM1 | 0.50 | HMDI | Inv. |
| 3 | BR1 | ACM1 | 0.40 | HMDI | Inv. |
| 4 | NBR1 | ACM1 | 0.95 | HMDI | Inv. |
| 5 | BR2 | — | 1.00 | HMDI | Comp. |
| 6 | — | ACM1 | 0.00 | HMDI | Comp. |
| 7 | BR1 | ACM1 | 0.80 | Sulfur | Comp. |

Inv.: Inventive example
Comp.: Comparative example

«Evaluation of Intermediate Transfer Materials 1 to 7»

An evaluation apparatus was prepared by attaching each of the intermediate transfer materials 1 to 7 to an image-forming apparatus "Bizhub™ PRESS C1100" (made by Konica Minolta, Inc.). By using this apparatus, a durability test was conducted to form 100,000 sheets of prints on Konica Minolta J paper (68 g/m$^2$) having an image with printed ratio of 10%. At the initial stage and at the final stage of this durability test, two kinds of images were respectively printed on Leathac 66 (made by Tokusyu Tokai Paper Co. Ltd.). One image is a half-tone cyan color image, and the other image is a solid two color image composed of cyan and magenta.

<Stripes in Axial Direction>

Evaluation Criteria

A half-tone cyan color image was evaluated in accordance with the evaluation criteria described below.

In a A3 sized sheet of print,

○: There is no white stripe having a length of 5 mm or more (passing an examination);

Δ: There are one or two white stripes having a length of 5 mm or more (passing an examination); and ×: There are three or more white stripes having a length of 5 mm or more (failing an examination).

<Density Unevenness>

Evaluation Criteria:

A solid two color image composed of cyan and magenta was evaluated in accordance with the evaluation criteria described below.

An A4 sized sheet of print was divided in 16 portions (4×4), a transmission density in each point was measured.

○: The difference between the maximum density and the minimum density is less than 0.1 (passing an examination);

Δ: The difference between the maximum density and the minimum density is 0.1 or more to less than 0.3 (passing an examination); and ×: The difference between the maximum density and the minimum density is 0.3 or more (failing an examination).

The obtained evaluation results are listed in Table 2.

TABLE 2

| | Initial image quality | | Image quality after 100,000 times of printing | | |
|---|---|---|---|---|---|
| Intermediate Transfer Material No. | Stripes in an axial direction | Density uneven-ness | Stripes in an axial direction | Density uneven-ness | Re-marks |
| 1 | ○ | ○ | ○ | ○ | Inv. |
| 2 | ○ | ○ | ○ | ○ | Inv. |
| 3 | ○ | ○ | ○ | Δ | Inv. |
| 4 | ○ | ○ | Δ | ○ | Inv. |
| 5 | ○ | ○ | X | X | Comp. |
| 6 | ○ | Δ | ○ | X | Comp. |
| 7 | ○ | ○ | X | ○ | Comp. |

Inv.: Inventive example

Comp.: Comparative example

From the results listed in Table 2, it is demonstrated that the intermediate transfer materials 1 to 4 of the present invention exhibited small amount of stripes and density unevenness even after durability test compared with the comparative intermediate transfer materials 5 to 7.

What is claimed is:

1. An intermediate transfer material used for an electrophotographic image-forming apparatus in which a toner image held on an electrostatic latent image carrier is primarily transferred to an intermediate transfer material, and then, the primarily transferred toner image is transferred from the intermediate transfer material to a transfer material through a secondary transfer device, wherein the intermediate transfer material has a substrate layer and an elastic layer;

the elastic layer contains a structure composed of a rubber having a double bond ($C_2$) and a rubber having no double bond ($C_0$) being bonded with each other through a urethane bond; and a mass ratio of the rubber having a double bond ($C_2$) to the rubber having no double bond ($C_0$) satisfies Scheme 1, $$0.5 \leq C_2/(C_2+C_0) \leq 0.9 \quad \text{Scheme 1.}$$

2. The intermediate transfer material described in claim 1, wherein the rubber having a double bond ($C_2$) and the rubber having no double bond ($C_0$) each are a hydroxy group modified rubber.

3. An electrophotographic image-forming apparatus in which a toner image held on an electrostatic latent image carrier is primarily transferred to an intermediate transfer material, and then, the primarily transferred toner image is transferred from the intermediate transfer material to a transfer material through a secondary transfer device, wherein the electrophotographic image-forming apparatus comprises the intermediate transfer material described in claim 1.

* * * * *